US012221723B2

(12) United States Patent
Chiang et al.

(10) Patent No.: US 12,221,723 B2
(45) Date of Patent: Feb. 11, 2025

(54) LIQUID COLOR MASTERBATCH COMPOSITION AND FABRICATING METHOD FOR COLORED FIBER

(71) Applicant: TAIWAN TEXTILE RESEARCH INSTITUTE, New Taipei (TW)

(72) Inventors: Rih-Sheng Chiang, New Taipei (TW); Wei-Jen Lai, New Taipei (TW); Huang-Chin Hung, New Taipei (TW)

(73) Assignee: TAIWAN TEXTILE RESEARCH INSTITUTE, New Taipei (TW)

( * ) Notice: Subject to any disclaimer, the term of this patent is extended or adjusted under 35 U.S.C. 154(b) by 131 days.

(21) Appl. No.: 18/164,658

(22) Filed: Feb. 6, 2023

(65) Prior Publication Data

US 2024/0084483 A1 Mar. 14, 2024

(30) Foreign Application Priority Data

Aug. 23, 2022 (TW) ..... 111131763

(51) Int. Cl.

| | |
|---|---|
| ***D06P 1/00*** | (2006.01) |
| ***D01F 1/06*** | (2006.01) |
| ***D01F 6/62*** | (2006.01) |
| ***D06P 1/14*** | (2006.01) |
| ***D06P 3/52*** | (2006.01) |

(52) U.S. Cl.

CPC ..... *D01F 1/06* (2013.01); *D01F 6/62* (2013.01); *D06P 1/14* (2013.01); *D06P 3/52* (2013.01)

(58) Field of Classification Search

CPC ..... D01F 1/06; D01F 6/62; D01F 6/92; D06P 1/14; D06P 3/52; D01D 1/04

USPC ..... 8/661

See application file for complete search history.

(56) References Cited

U.S. PATENT DOCUMENTS 6,569,422 B1 * 5/2003 van Loon ..... A61P 37/00 435/235.1
7,189,283 B2 * 3/2007 Patel ..... C09B 67/006 8/661
7,211,134 B2 * 5/2007 Tateishi ..... C09D 11/32 8/661
7,300,503 B2 * 11/2007 Tateishi ..... C09B 47/0678 106/31.78
7,326,287 B2 * 2/2008 Patel ..... C09D 11/328 347/100
7,449,058 B2 * 11/2008 Patel ..... C09B 47/065 347/100
7,575,626 B2 * 8/2009 Patel ..... C09D 11/328 106/31.47
7,575,627 B2 * 8/2009 Patel ..... C09D 11/32 106/31.47
7,641,726 B2 * 1/2010 Patel ..... C09B 47/0678 106/31.47
8,647,425 B2 * 2/2014 Patel ..... C09D 11/328 106/31.47
8,876,915 B2 * 11/2014 Fujie ..... C09B 47/04 8/637.1
2006/0201387 A1 * 9/2006 Patel ..... C09B 67/006 347/100
2009/0083912 A1 * 4/2009 Lehmann ..... C09B 47/26 540/465
2009/0202930 A1 * 8/2009 Furukawa ..... G03G 9/0924 430/105
2012/0081482 A1 * 4/2012 Dunwoody ..... C09B 47/067 8/639
2012/0121868 A1 * 5/2012 Patel ..... C09D 11/328 347/86
2021/0053253 A1 2/2021 Jones et al.
2022/0348726 A1 * 11/2022 Chiang ..... C08J 3/22

FOREIGN PATENT DOCUMENTS

| | | | | |
|---|---|---|---|---|
| CN | 102465350 A | | 5/2012 | |
| CN | 102504599 A | | 6/2012 | |
| CN | 112143107 A | * | 12/2020 | ..... C08J 3/226 |
| EP | 2193156 A2 | | 6/2010 | |
| JP | 4230141 B2 | * | 2/2009 | ..... C09D 11/00 |
| TW | 202237780 A | | 10/2022 | |
| TW | 202242032 | | 11/2022 | |

OTHER PUBLICATIONS

STIC Search Report dated Jun. 8, 2024.*

* cited by examiner

*Primary Examiner* — Eisa B Elhilo

(74) *Attorney, Agent, or Firm* — McClure, Qualey & Rodack, LLP

(57) ABSTRACT

A liquid color masterbatch composition for fabricating a colored fiber includes 5 parts by weight to 45 parts by weight of a colorant, 40 parts by weight to 94 parts by weight of a carrier, and 1 part by weight to 15 parts by weight of a lubricant, in which a chemical structure of the lubricant includes a carbonyl group and an amine group.

9 Claims, No Drawings

LIQUID COLOR MASTERBATCH COMPOSITION AND FABRICATING METHOD FOR COLORED FIBER

RELATED APPLICATION

This application claims priority to Taiwan Application Serial Number 111131763, filed on Aug. 23, 2022, which is herein incorporated by reference.

BACKGROUND

Field of Invention

The present disclosure relates to a color masterbatch composition and a fiber, and particularly relates to a liquid color masterbatch composition and a colored fiber fabricated thereby.

Description of Related Art

In the fabricating process of the color masterbatch for fiber in the textile industry, color powders and plastic particles are usually stirred and mixed, and then the mixture is placed into a kneading extruder for kneading granulation to form masterbatches for fiber. However, color spots are often generated on the color masterbatch for fiber that is fabricated by the above process due to the uneven dispersibility of the color powders, which leads to a poor color rendering property of the subsequently fabricated colored fiber (e.g., low color saturation of colored fiber). As a result, it is often necessary to add more colorants to solve the problem of poor color rendering property. Therefore, how to provide a color masterbatch for fiber which is capable of providing a colored fiber with a good color rendering property is a problem to be solved for the textile industry.

SUMMARY

The present disclosure provides a liquid color masterbatch composition for fabricating a colored fiber and a fabricating method for the colored fiber, in which the liquid color masterbatch composition has good dispersibility, such that the colored fiber fabricated thereby has a good color rendering property.

According to some embodiments of the present disclosure, a liquid color masterbatch composition for fabricating a colored fiber includes 5 parts by weight to 45 parts by weight of a colorant, 40 parts by weight to 94 parts by weight of a carrier, and 1 part by weight to 15 parts by weight of a lubricant, in which a chemical structure of the lubricant includes a carbonyl group and an amine group.

In some embodiments of the present disclosure, the lubricant includes dimethylacetamide (DMAC).

In some embodiments of the present disclosure, the colorant includes a blue colorant.

In some embodiments of the present disclosure, the blue colorant has a chemical structure represented by formula (1):

formula (1)

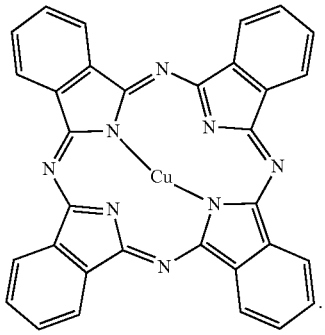

In some embodiments of the present disclosure, the carrier includes a nonionic surfactant, an anionic surfactant, a cationic surfactant, a zwitterionic surfactant, or combinations thereof.

In some embodiments of the present disclosure, a particle size (D90) of a dispersed substance in the liquid color masterbatch composition is between 290 nm and 310 nm.

In some embodiments of the present disclosure, a viscosity of the liquid color masterbatch composition at 25° C. is between 10000 cP and 13000 cP.

According to some other embodiments of the present disclosure, a fabricating method for a colored fiber includes the following steps. A mixing step is performed, thereby uniformly mixing polyester with the liquid color masterbatch composition mentioned above to form a mixture. A kneading step is performed on the mixture, thereby forming a color masterbatch for fiber. A melt spinning step is performed on the color masterbatch for fiber, thereby forming the colored fiber, in which based on a total weight of the colored fiber, a content of the polyester is between 99.750 wt. % and 99.875 wt. %, and a content of the colorant is between 0.125 wt. % and 0.250 wt. %.

In some embodiments of the present disclosure, in the mixing step, the polyester has a molten form, and the mixing step and the kneading step are performed in a same process.

In some embodiments of the present disclosure, a temperature of the melt spinning step is between 265° C. and 275° C.

In the aforementioned embodiments of the present disclosure, the liquid color masterbatch composition of the present disclosure includes an appropriate amount of the colorant, an appropriate amount of the carrier, and an appropriate amount of the lubricant, in which the lubricant can provide good compatibility between the carrier and the colorant, such that the liquid color masterbatch composition has good dispersibility and spinnability. As a result, the colored fiber fabricated from the liquid color masterbatch composition has a good color rendering property, such as high color saturation.

DETAILED DESCRIPTION

Reference will now be made in detail to the present embodiments of the disclosure, examples of which are illustrated in the accompanying drawings. Wherever possible, the same reference numbers are used in the drawings and the description to refer to the same or like parts.

The present disclosure provides a liquid color masterbatch composition for fabricating a colored fiber and a fabricating method for the colored fiber. The liquid color masterbatch composition of the present disclosure includes an appropriate amount of a colorant, an appropriate amount of a lubricant, and an appropriate amount of a carrier, and a chemical structure of the lubricant has a carbonyl group and an amine group. Therefore, the liquid color masterbatch composition has good dispersibility and spinnability, such that the colored fiber fabricated from the liquid color masterbatch composition has a good color rendering property, such as high color saturation.

The liquid color masterbatch composition of the present disclosure includes 5 parts by weight to 45 parts by weight of a colorant, 40 parts by weight to 94 parts by weight of a carrier, and 1 part by weight to15 parts by weight of a lubricant, and a chemical structure of the lubricant includes a carbonyl group and an amine group. Specifically, the carbonyl group in the chemical structure of the lubricant can provide good compatibility between the lubricant and the carrier, and the amine group in the chemical structure of the lubricant can provide good compatibility between the lubricant and the colorant, and therefore, the lubricant can allow good and uniform dispersion and mixing of the carrier and the colorant, such that the liquid color masterbatch composition has good spinnability. In some embodiments, a viscosity of the liquid color masterbatch composition at room temperature (e.g., 25° C.) can be between 10000 cP and 13000 cP, thereby providing good dispersibility. In detail, if the viscosity of the liquid color masterbatch composition is less than 10000 cP, the liquid color masterbatch composition may be difficult to control due to its high fluidity, thus may not be uniformly mixed with polyester; if the viscosity of the liquid color masterbatch composition is greater than 13000 cP, the liquid color masterbatch composition may not be uniformly mixed with polyester due to low dispersibility. In some preferred embodiments, the viscosity of the liquid color masterbatch composition at room temperature (e.g., 25° C.) can be between 12000 cP and 13000 cP, thereby providing better dispersibility. In some embodiments, a particle size (D90) of a dispersed substance in the liquid color masterbatch composition may be between 290 nm and 310 nm, such that the liquid color masterbatch composition is provided with good dispersibility to facilitate the subsequent fabrication of the colored fiber.

The liquid color masterbatch composition of the present disclosure includes 5 parts by weight to 45 parts by weight of the colorant. The above content (ratio) of the colorant can provide the liquid color masterbatch composition with a sufficiently vivid color. In some embodiments, the colorant may be, for example, a blue colorant, such that the liquid color masterbatch composition and the subsequently formed colored fiber have a blue color. In some embodiments, the blue colorant may be, for example, a keto phthalocyanine (phthalocyanine blue) pigment, so as to provide good fastness, good heat resistance, and a vivid blue color. Specifically, the blue colorant may have a molecular structure represented by formula (1), formula (1)

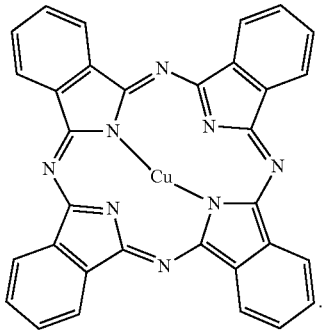

The liquid color masterbatch composition of the present disclosure includes 40 parts by weight to 94 parts by weight of the carrier. The above content (ratio) of the carrier can make the colorant uniformly disperse in the carrier, and can provide the liquid color masterbatch composition with good dispersibility. In some embodiments, the carrier may include a nonionic surfactant, an anionic surfactant, a cationic surfactant, a zwitterionic surfactant, or combinations thereof. When the colorant is the aforementioned keto phthalocyanine pigment, the carrier may preferably include the anionic surfactant, such that the colorant has better dispersibility. In some embodiments, the nonionic surfactant may include an ethoxy compound; the anionic surfactant may include phosphate, sulfonate, or combinations thereof; the cationic surfactant may include an organic ammonium salt, a quaternary ammonium salt, or combinations thereof; the zwitterionic surfactant may include amino acid.

The liquid color masterbatch composition of the present disclosure includes 1 part by weight to 15 parts by weight of the lubricant. The above content (ratio) of the lubricant can provide the components in the liquid color masterbatch composition with good compatibility, such that the liquid color masterbatch composition has a suitable particle size, thereby providing good dispersibility. In some embodiments, a weight average molecular weight of the lubricant may be between 600 g/mole and 900 g/mole, such that the liquid color masterbatch composition has better heat resistance, thereby being preferably suitable for the subsequent kneading step and spinning step. In some embodiments, the lubricant may include dimethylacteamide (DMAC), which not only provides good compatibility between the components in the liquid color masterbatch composition, but also provides a moisturizing effect on the colorant, thereby improving the dispersibility of the colorant.

Based on the above, since the liquid color masterbatch composition of the present disclosure includes an appropriate amount of the colorant, an appropriate amount of the carrier, and an appropriate amount of the lubricant, and based on the design of the chemical structure of the lubricant, the components in the liquid color masterbatch composition have good compatibility, such that the liquid color masterbatch composition has good dispersibility and spinnability. As a result, the colored fiber fabricated from the liquid color masterbatch composition has a good color rendering property, such as high color saturation. In the following description, a method for fabricating a colored fiber using the aforementioned liquid color masterbatch composition will be further described, that is, a fabricating method for a colored fiber of the present disclosure will be further described.

The fabricating method for the colored fiber of the present disclosure includes steps S10 to S30. In step S10, a mixing step is performed to uniformly mix polyester and the aforementioned liquid color masterbatch composition, such that a mixture is formed. In step S20, a kneading step is performed on the mixture, thereby forming a color masterbatch for fiber. In step S30, a melt spinning step is performed on the color masterbatch for fiber, thereby forming the colored fiber.

Before performing step S10, the aforementioned liquid color masterbatch composition may be fabricated firstly. Specifically, 5 parts by weight to 45 parts by weight of the colorant, 40 parts by weight to 94 parts by weight of the carrier, and 1 part by weight to 15 parts by weight of the lubricant can be mixed to form a mixed liquid, and then a dispersing step is performed on the mixed liquid to form the liquid color composition. In some embodiments, the dispersing step can be carried out by, for example, a three-roller device, and a rotation speed of a single roller can be between 10 rpm and 1000 rpm, so as to uniformly disperse the components in the liquid color masterbatch composition and make the liquid color masterbatch composition have a suitable particle size. As such, the liquid color masterbatch composition is provided with good dispersibility for being uniformly mixed with polyester in subsequence.

Then, in step S10, a mixing step is performed to uniformly mix the liquid color masterbatch composition and polyester to form a mixture. It is worth noting that, since each component in the liquid color masterbatch composition (e.g., the colorant, carrier, and lubricant) has good compatibility with polyester, the mixture of the liquid color masterbatch composition and polyester can have good homogeneity and low thixotropy, such that the mixture can be smoothly injected into the peristaltic pump in the subsequent melt spinning step. In some embodiments, the liquid color masterbatch composition and the polyester can be uniformly mixed by screw stirring. In some embodiments, the mixing step can be, for example, carried out at room temperature, a time of the mixing step can be between 10 minutes and 30 minutes, and a rotation speed of the screw can be between 100 rpm and 500 rpm, so as to ensure the liquid color masterbatch composition is uniformly mixed with the polyester. In some embodiments, the polyester may be, for example, polyethylene terephthalate (PET), polybutylene terephthalate (PBT), or a combination thereof. In some embodiments, the polyester may have a powder form in the mixing step. In some other embodiments, the polyester may have a molten form in the mixing step. In other words, the mixing step can be a step mixing solid (the polyester with the powder form) and liquid (liquid color masterbatch composition), or a step mixing liquid (the polyester with the molten form) and liquid (liquid color masterbatch combination).

In some embodiments, when the polyester has a powder form in the mixing step, a drying step may be performed on the mixture after the mixing step and before the kneading step, such that the mixture has a powder form to facilitate the subsequent kneading step. In some embodiments, a temperature of the kneading step can be between 90° C. and 110° C., and a time of the kneading step can be between 12 hours and 24 hours, so as to ensure that the mixture is completely dried to have a powder form. In some other embodiments, when the polyester has a molten form in the mixing step, the mixing step and the subsequent kneading step may be performed in the same process, which will be described in more detail below in step S20.

In step S20, a kneading step is performed on the mixture, such that a color masterbatch for fiber is formed. In some embodiments, when the polyester has a powder form in the aforementioned mixing step, the resulting mixture with a powder form may undergo a kneading step to further form the color masterbatch for fiber, and a temperature of the kneading step may be between 220° C. and 250° C. In some other embodiments, when the polyester has a molten form in the aforementioned mixing step, the mixing step and the kneading step may be performed in the same process. In detail, the polyester can be placed in a kneading extruder to form a molten polyester, and the liquid color masterbatch composition can be injected into the kneading extruder at the same time to mix with the molten polyester, such that the mixing step and the kneading step are simultaneously carried out, in which temperature of the kneading step can be between 220° C. and 250° C., a feeding amount of the polyester can be, for example, between 85 g/min and 90 g/min, and a feeding amount of the liquid color masterbatch composition can be, for example, between 35 g/min and 40 g/min, so as to improve the color rendering properties of the color masterbatch for fiber and the colored fiber fabricated thereby. During the mixing step, the lubricant and carrier in the liquid color masterbatch composition can be pumped off, that is, the formed color masterbatch for fiber may include the colorant and the polyester but not the lubricant and the carrier.

After step S20 is performed, the color masterbatch for fiber can be formed. In the fabricating process of the color masterbatch for fiber, the colorant, the lubricant, and the carrier are uniformly mixed to form the liquid color masterbatch composition, and then the liquid color masterbatch composition and polyester are uniformly mixed and kneaded to form the color masterbatch for fiber; therefore, the dispersibility of the colorant in the color masterbatch for fiber can be improved, such that the problem of the uneven distribution of the colorant in the color masterbatch for fiber can be solved, and the color rendering property of the color masterbatch for fiber and the colored fiber fabricated thereby can be improved.

In step S30, a melt spinning step is performed on the color masterbatch for fiber to form a colored fiber. Specifically, the color masterbatch for fiber can be mixed with an appropriate amount of polyester (the material of which can be the same as the material of the aforementioned polyester) to perform the melt spinning step, thereby obtaining the colored fiber of the present disclosure. In some embodiments, a temperature of the melt spinning step may be between 265° C. and 275° C., so as to provide good spinnability to the color masterbatch for fiber. It should be noted that, the lubricant of the present disclosure will reduce the viscosity of polyester during the spinning process. Therefore, by setting the temperature of the melt-spinning step to be in the above range, the total viscosity of the color masterbatch for fiber and the polyester can be maintained to improve spinnability, and the destruction of the properties of each component in the color masterbatch for fiber due to the excessively high temperature of the melt spinning step can be avoided. In some embodiments, based on a total weight of the colored fiber, a content of the polyester may be between 99.750 wt. % and 99.875 wt. %, and a content of the colorant may be between 0.125 wt. % and 0.250 wt. %, such that the colored fiber is provided with a good color rendering property. It is worth mentioning that the colored fiber fabricated according to the above steps S10 to S30 can be an intrinsic colored fiber. That is, the fiber does not need to undergo an additional dyeing step to have its color. In some embodiments, the color of the colored fiber is similar to or the same as the color of the colorant in the aforementioned liquid color masterbatch composition.

It should be understood that the connection relationships and the functions of the components that have been described will not be repeated hereinafter. In the following description, various tests and evaluations will be performed on the liquid color masterbatch compositions and colored fibers of multiple comparative examples and multiple embodiments to further verify the efficacy of the present disclosure.

Experiment 1: Evaluation on Properties of Liquid Color Masterbatch Compositions In this experiment, the particle size, dispersibility, and viscosity of the liquid color masterbatch compositions of each comparative example and each embodiment were evaluated. The particle size and dispersibility of the liquid color masterbatch compositions were evaluated by particle size analyzer (Model: Malvern Zetasizer Nano ZS90), and the dispersibility of the liquid color masterbatch compositions was represented by the polymer dispersity index (PDI). The viscosity of the liquid color masterbatch compositions was evaluated by viscometer (Model: BROOKFIELD DV-E) at room temperature. The detailed description and evaluation results of the liquid color masterbatch compositions of each comparative example and each embodiment are shown in Table 1.

TABLE 1

| | Content of Each Component in the Liquid Color Masterbatch Composition (Part by Weight) | | | Viscosity | Particle Size (D90) | |
|---|---|---|---|---|---|---|
| | Colorant | Carrier | Lubricant | (cP) | (nm) | PDI |
| Comparative example 1 | 30 | 70 | 0 | 13650 | 318 | 0.200 |
| Embodiment 1 | 40 | 15 | 45 | 12400 | 298 | 0.198 |

It can be seen from the results in Table 1 that when no carrier is added to the liquid color masterbatch composition, the viscosity, particle size, and PDI of the liquid color masterbatch composition are relatively large, resulting in poor fluidity and poor dispersibility; relatively, when the liquid color masterbatch composition includes an appropriate amount of the lubricant and the carrier, the viscosity, particle size, and PDI of the liquid master composition are relatively small, and the dispersibility is better.

Experiment 2: Evaluation on Spinnability and Processability of Liquid Color Masterbatch Compositions In this experimental, the commercially available color masterbatch and the liquid color masterbatch composition of the aforementioned Comparative Example 1 and Embodiment 1 were respectively mixed with an appropriate amount of polyester to form the mixtures of each comparative example and each embodiment, and the mixtures of each comparative example and each example were spun to obtain partially oriented yarns (POY) with a fiber specification of 130 d/48 f, and then a false twisting process was performed on the POY to obtain draw textured yarns (DTY). The detailed description and evaluation results of the mixtures of each comparative example and each embodiment are shown in Table 2.

TABLE 2

| | Liquid Color Masterbatch Composition | Content of Polyester (wt. %) | Content of Blue Colorant (wt. %) | POY Strength (g/d) | DTY strength (g/d) |
|---|---|---|---|---|---|
| Comparative Example 2 | Commercially Available Color Masterbatch | 99 | 0.25 | 2.2 | 2.8 |
| Comparative Example 3 | Commercially Available Color Masterbatch | 98 | 0.125 | 2.1 | 2.9 |
| Comparative Example 4 | Comparative Example 1 | 99.75 | 0.25 | 1.27 | not processable |
| Embodiment 2 | Embodiment 1 | 99.875 | 0.125 | 1.91 | 3.1 |
| Embodiment 3 | Embodiment1 | 99.75 | 0.25 | 1.24 | 2.9 |

As can be seen from the results in Table 2, for spinnability (POY), each comparative example and each embodiment have good spinnability; for processability (DTY), when no lubricant was added to the liquid color masterbatch composition, the mixture was not processable (e.g., the mixture of Comparative Example 4 was not processable), and when lubricant was added to the liquid color masterbatch composition, the DTY that were spun and processed from the mixture can have high fiber strength (e.g., the DTY processed from the mixture of Embodiments 2 to 3 shows high fiber strength).

Experiment 3: Evaluation on Color Rendering Property of Colored Fibers

In this experiment, the mixtures of the foregoing Comparative Examples 2 to 3 and the foregoing Embodiments 2 to 3 were respectively spun to form the colored fibers of Comparative Examples 5 to 6 and Embodiments 4 to 5, and the color rendering properties of the colored fibers of Comparative Examples 5 to 6 and Embodiments 4 to 5 were evaluated. Specifically, in this experiment, the color rendering properties were evaluated through the L value, C value, and H value of the colored fibers in the LCH color space. The detailed evaluation results of the colored fibers of each comparative example and each embodiment are shown in Table 3.

TABLE 3

| | Mixture | L (lightness) | C (saturation) | H (hue) |
|---|---|---|---|---|
| Standard Color Card Data PANTONE Classic Blue | N/A | 30.9 | 35.9 | 265.7 |
| Comparative Example 5 | Comparative example 2 | 68.52 | 33.96 | 230.15 |
| Comparative Example 6 | Comparative example 3 | 59.77 | 37.24 | 235.67 |
| Embodiment 4 | Embodiment 2 | 64.11 | 37.32 | 228.79 |
| Embodiment 5 | Embodiment 3 | 57.62 | 40.64 | 230.0 |

It can be seen from the results in Table 3 that although the color fibers of each comparative example and each embodiment can display the same blue color as the standard color card data, the color saturation of the color fibers of Embodiments 4 to 5 is higher than the color saturation of the standard color card data, and the color saturation (C value) of the colored fiber of Embodiment 5 can reach 40.64. It can be seen that the liquid color masterbatch composition of the present disclosure can make the blue colored fiber present a more saturated color (brighter color), providing better color rendering properties. In addition, the colored fiber of Embodiment 5 can also have a reflective feeling visually, so as to achieve a brighter feeling visually.

Experiment 4: Evaluation on Color Fastness to Washing, Sweat, and Light of Colored Fibers In this experiment, the colored fibers of Embodiments 4 and 5 were evaluated for color fastness to washing, sweat, and light, in which color fastness to washing is performed under the AATCC 61-2013 1A standard method, color fastness to sweat is evaluated under the AATCC 15-2013 standard method, and the color fastness to light is evaluated under the AATCC 16.3 option 3 standard method. The evaluation results are shown in Table 4.

TABLE 4

| | | contamination | | | | | |
|---|---|---|---|---|---|---|---|
| | color fade | wool | acrylic | tedron | nylon | cotton | acetate acid |
| | evaluation on color fastness to washing (level) | | | | | | |
| embodiment 4 | 4.5 | 4.5 | 4.5 | 4.5 | 4.5 | 4.5 | 4.5 |
| embodiment 5 | 4.5 | 4.5 | 4.5 | 4.5 | 4.5 | 4.5 | 4.5 |
| | evaluation on color fastness to sweat (level) | | | | | | |
| embodiment 4 | 4.5 | 4.5 | 4.5 | 4.5 | 4.5 | 4.5 | 4.5 |
| embodiment 5 | 4.5 | 4.5 | 4.5 | 4.5 | 4.5 | 4.5 | 4.5 |
| | evaluation on color fastness to light (level) | | | | | | |
| embodiment 4 | >4 | >4 | >4 | >4 | >4 | >4 | >4 |
| embodiment 5 | >4 | >4 | >4 | >4 | >4 | >4 | >4 |

It can be seen from the results in Table 4 that the colored fibers of embodiments 4 to 5 have hardly any color transfer to wool, acrylic, tedron, nylon, cotton, and acetic acid after the evaluation on color fastness to washing, sweat, and light, indicating that the liquid color masterbatch composition of the present disclosure will not affect the performance of the colored fiber in color fastness to washing, sweat, and light, thereby providing a wide range of applications.

According to the aforementioned embodiments of the present disclosure, the liquid color masterbatch composition of the present disclosure includes an appropriate amount of the colorant, an appropriate amount of the carrier, and an appropriate amount of the lubricant, in which the lubricant can provide good compatibility between the carrier and the colorant, such that the liquid color masterbatch composition has good dispersibility and spinnability. As a result, the colored fiber fabricated from the liquid color masterbatch composition has a good color rendering property, such as high color saturation. On the other hand, the colored fiber fabricated by using the liquid color masterbatch composition of the present disclosure can have good color fastness to washing, sweat, and light, and thus providing a wide range of applications.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure covers modifications and variations of this disclosure provided they fall within the scope of the following claims.

What is claimed is:

1. A liquid color masterbatch composition for fabricating a colored fiber, comprising:

5 parts by weight to 45 parts by weight of a colorant;

40 parts by weight to 94 parts by weight of a carrier; and 1 part by weight to 15 parts by weight of a lubricant, wherein the lubricant comprises dimethylacetamide.

2. The liquid color masterbatch composition of claim 1, wherein the colorant comprises a blue colorant.

3. The liquid color masterbatch composition of claim 2, wherein the blue colorant has a chemical structure represented by formula (1):

formula (1)

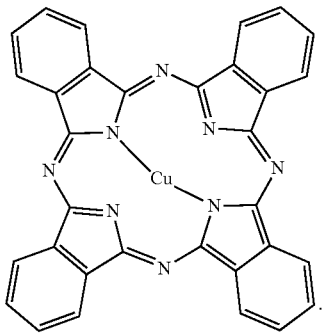

4. The liquid color masterbatch composition of claim 1, wherein the carrier comprises a nonionic surfactant, an anionic surfactant, a cationic surfactant, a zwitterionic surfactant, or combinations thereof.

5. The liquid color masterbatch composition of claim 1, wherein a particle size (D90) of the liquid color masterbatch composition is between 290 nm and 310 nm.

6. The liquid color masterbatch composition of claim 1, wherein a viscosity of the liquid color masterbatch composition at 25° C. is between 10000 cP and 13000 cP.

7. A fabricating method for a colored fiber, comprising:

performing a mixing step, thereby uniformly mixing polyester with the liquid color masterbatch composition of claim 1 to form a mixture;

performing a kneading step on the mixture, thereby forming a color masterbatch for fiber; and performing a melt spinning step on the color masterbatch for fiber, thereby forming the colored fiber, wherein based on a total weight of the colored fiber, a content of the polyester is between 99.750 wt. % and 99.875 wt. %, and a content of the colorant is between 0.125 wt. % and 0.250 wt. %.

8. The fabricating method for the colored fiber of claim 7, wherein in the mixing step, the polyester has a molten form, and the mixing step and the kneading step are performed in a same process.

9. The fabricating method for the colored fiber of claim 7, wherein a temperature of the melt spinning step is between 265° C. and 275° C.

* * * * *